US006946795B2

(12) United States Patent
Jeon et al.

(10) Patent No.: US 6,946,795 B2
(45) Date of Patent: Sep. 20, 2005

(54) BULB OF ELECTRODELESS LAMP APPARATUS

(75) Inventors: Yong-Seog Jeon, Gwangmyung (KR); Joon-Sik Choi, Seoul (KR); Hyun-Jung Kim, Seoul (KR); Hyo-Sik Jeon, Gwangmyung (KR); Ji-Young Lee, Gwangmyung (KR); Byeong-Ju Park, Seoul (KR)

(73) Assignee: LG Electronics Inc., Seoul (KR)

( * ) Notice: Subject to any disclaimer, the term of this patent is extended or adjusted under 35 U.S.C. 154(b) by 105 days.

(21) Appl. No.: 10/607,993

(22) Filed: Jun. 30, 2003

(65) Prior Publication Data

US 2004/0120147 A1 Jun. 24, 2004

(30) Foreign Application Priority Data

Dec. 24, 2002 (KR) ..... 10-2002-0083618

(51) Int. Cl.[7] ..... H01J 65/00

(52) U.S. Cl. ..... 313/607; 313/638

(58) Field of Search ..... 313/607, 568, 313/570, 572, 160, 161, 567, 637, 638, 643

(56) References Cited

U.S. PATENT DOCUMENTS 6,734,630 B1 * 5/2004 Choi et al. ..... 313/638

* cited by examiner

*Primary Examiner*—Joseph Williams
(74) *Attorney, Agent, or Firm*—Greenblum & Bernstein, P.L.C.

(57) ABSTRACT

A bulb for an electrodeless lamp system uses Sn or halogenide of the Sn as a primary bulb fill for obtaining continued spectrum when it is discharged, and the halogenide of the Sn is $SnBr_2$. Therefore, high photoefficiency and superior color rendering can be obtained, and less ultraviolet ray than that of sulfur is radiated and warm feeling can be obtained visually.

15 Claims, 2 Drawing Sheets

BULB OF ELECTRODELESS LAMP APPARATUS

BACKGROUND OF THE INVENTION

1. Field of the Invention

The present invention relates to an electrodeless lamp apparatus using microwave, and particularly, to a filled material filled in a bulb of the electrodeless lamp apparatus.

2. Description of the Background Art

Generally, an electrodeless lamp system provides higher economical efficiency and idealistic natural light than any other conventional lamps.

The electrodeless lamp system is operated in following lighting mechanism. That is, microwave (high frequency) generated from a magnetron of a high frequency oscillator makes inert gas in a bulb into plasma, which is ionized status.

And above plasma status is maintained to make metal compound in the bulb emit light continuously, and thereby, high quantity of light can be provided without an electrode.

The above electrodeless lamp system has following properties.

Luminous flux corresponding to that of four metal halide lamps of 400 W can be generated by one electrodeless lamp system, energy consumption can be reduced by 20% or more, and a built-in stabilizer is used, and therefore, there is no need to use an additional stabilizer.

Also, the light is emitted by the plasma without a filament, and therefore, the lamp system can be used for a long time without lowering the flux.

Also, since continuous optical spectrum same as the natural white-light is realized by the electrodeless lamp system, it is able to function similarly to the sun light, and it is useful where the sun light is not streamed into or where color discrimination is made.

In addition, the electrodeless lamp system does not use fluorescent material to protect visual acuity, and is able to minimize radiation of infrared ray and ultraviolet ray to provide comfortable lighting environment.

FIG. 1 is a longitudinal cross-sectional view showing a conventional electrodeless lamp system.

As shown therein, the conventional electrodeless lamp system comprises: a magnetron 2 installed on inner upper end of a casing 1 for generating microwave; a bulb 5 located on upper part of the magnetron 2 and including luminescent material and buffer gas filled therein for generating light by making the filled fluorescent material into plasma by the microwave energy; a resonator 6 including the bulb 5 and passing the light generated from the bulb 5 while blocking the generated microwave; and a dielectric mirror 8 installed on lower part of the resonator 6 for transmitting the microwave generated from the magnetron 2 and reflecting the light.

The bulb 5 comprises: a light emitting portion 5*a* formed as a sphere using quartz, that is, light-transmitting material so that buffer gas, luminescent material and discharging catalyst material are filled therein, and a shaft portion 5*b* formed integrally on lower center portion of the light emitting portion 5*a* and coupled to a rotary shaft of a bulb motor (M1).

However, the light emitting portion 5*a* of the conventional bulb includes primary bulb fills emitting spectrum according to electron structure when it is excited to affect to emitting characteristics of the lamp, buffer gas contributing to initial discharge so that the primary bulb fills can be excited, and auxiliary bulb fill added in order to improve light property or to add a special function.

Sulfur (S) is used as the primary bulb fills filled in the light emitting portion 5*a*, and inert gas such as argon (Ar) (for example, Ne, Xe, Kr, etc.) is used as the buffer gas.

Also, halogenide of alkali metal (for example, NaI, KBr, etc.) and rare-earth halogenide (for example, $CaI_2$, $BaI_2$, etc.) is mainly used as the auxiliary bulb fill.

The conventional electrodeless lamp system as above is operated as follows.

First, when a driving signal is transferred to a controller, power source is supplied to the magnetron 2, and the magnetron 2 is oscillated by the power source to generate microwave having very high frequency.

Then, the microwave generated from the magnetron 2 is radiated into the resonator 6 to excite the buffer gas filled in the bulb 5, the sulfur, that is, the primary bulb fill becomes plasma continuously to generate the light having its own emission spectrum, and the light is reflected forward by a reflector and by the dielectric mirror 8 to enlighten the space.

However, according to the conventional electrodeless lamp system, luminosity factor is lowered and light efficiency is also lowered in case that the sulfur is used as the primary bulb fill, as shown in luminosity factor curved in FIG. 2.

SUMMARY OF THE INVENTION

Therefore, an object of the present invention is to provide a bulb for an electrodeless lamp system which is able to improve light efficiency of light generated from the bulb, to reduce ultraviolet ray radiation, and to arouse a warm feeling visually.

To achieve the object of the present invention, as embodied and broadly described herein, there is provided a bulb using Sn as a primary bulb fill in order to continued spectrum in discharging.

Also, the primary bulb fill is halogenide of the Sn.

Also, the halogenide of the Sn is stannum bromide ($SnBr_2$).

Also, filled amount of the primary bulb fill is within a range of 0.005~0.1 mol/cc.

Also, buffer gas filled in the bulb for contributing to initial discharging includes at least one or more among Ne, Ar, Kr and Xe.

Also, mercury is added as auxiliary bulb fill filled in the bulb for discharge stabilization and spectrum changing.

Also, an amount of the mercury is within a range of $10^{-7}$~$10^{-3}$ mol/cc.

Also, a capacity of the bulb is more than 50 watt/cc of power consumption concentration.

Also, there is provided an electrodeless lamp system comprising: a microwave generator for generating microwave by being supplied power source; a resonator for blocking the generated microwave and transmitting the light; and a bulb in which filled luminescent material becomes plasma by the generated microwave to generate light, wherein the bulb includes a primary bulb fill for obtaining continued spectrum in discharging.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

Reference will now be made in detail to the preferred embodiments of the present invention, examples of which are illustrated in the accompanying drawings.

Figure 1:
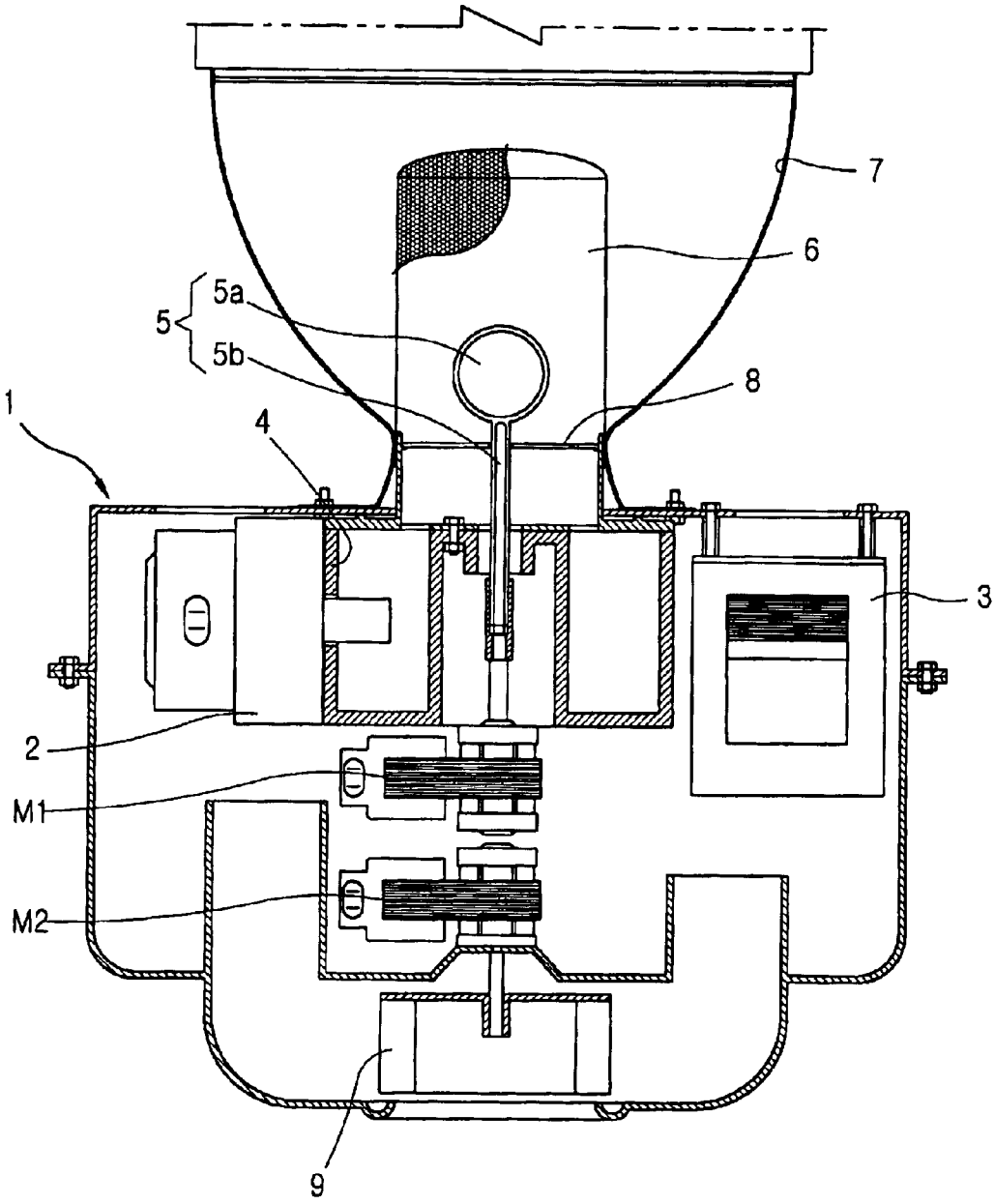
FIG. 1 PRIOR ART
FIG. 1 is a longitudinal cross-sectional view showing an entire structure of a conventional electrodeless lamp system.
Figure 2:
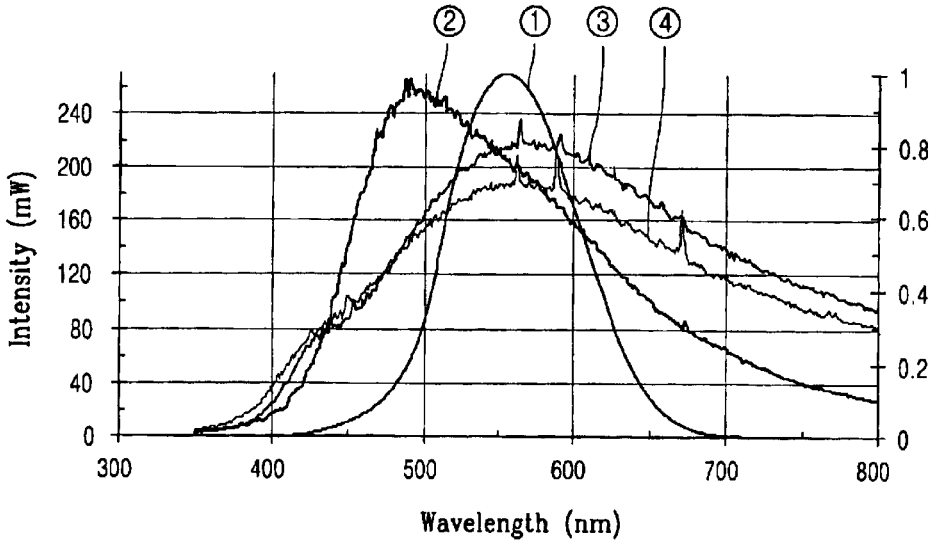
FIG. 2 is a graph showing luminosity factor of an electrodeless lamp bulb according to the present invention as comparing to that of the conventional art.

FIG. 1 is a longitudinal cross-sectional view showing an entire structure of a conventional electrodeless lamp system, and FIG. 2 is a graph showing luminosity factor by a bulb of an electrodeless lamp system according to the present invention as comparing to that of the conventional art.

As shown in FIG. 1, an electrodeless lamp system according to an embodiment of the present invention comprises: a magnetron 2 installed on inner upper end of a casing 1 for generating microwave; a power supply 3 installed on an inner upper end of the casing 1 to face the magnetron 2 for supplying power source to the magnetron 2; a waveguide 4 connected to an outlet portion of the magnetron 2 and installed between the magnetron 2 and the power supply 3 for transferring the microwave generated on the magnetron 2 to a bulb; a bulb 5 connected to a upper center portion of the waveguide 4 and including luminescent material, buffer gas and discharge catalyst material which become plasma by the microwave energy to generate light; a resonator 6 including the bulb 5 for blocking the microwave transferred from the waveguide 4 and transmitting the light generated from the bulb 5; a reflector 7 attached on a center upper portion of the casing 1 and receiving the resonator 6 to reflect intensively the light generated from the bulb 5 so that the light can go straight ahead; a dielectric mirror 8 installed between the waveguide 4 and the resonator 6 for transmitting microwave generated from the waveguide 4 and reflecting the light; and a cooling fan 9 installed on a lower part of the casing to cool down the magnetron 2 and the power supply 3.

The structure of the electrodeless lamp system according to the present invention can be modified variously by those who skilled in the art.

The bulb 5 is made using quartz, that is, a material having light transmittance, and comprises a light emitting portion 5*a* having a predetermined shape.

Also, in the light emitting portion 5*a*, a primary bulb fill radiating spectrum according to electron structure when it is excited to affect light emission property of the lamp, buffer gas contributing to initial discharging so that the primary bulb fill can be excited, and a discharge catalyst material added in order to improve light property or to add a special function are filled.

Tin or halogenide of the stannum is used as the primary bulb fill, and especially, it is desirable that stannum bromide ($SnBr_2$) is used as the halogenide of the tin.

At that time, the capacity of the light emitting portion 5*a* is more than 50 watt/cc of power consumption concentration, and at that time, it is desirable that filling amount of the stannum or the stannum bromide is within a range of 0.005~0.1 mol/cc.

Also, it is desirable that at least one inert gas of Ar, Ne, Xe and Kr or a compound thereof is used as the buffer gas.

Also, mercury (Hg) is filled as the auxiliary bulb fill for stablizing the discharge and changing the spectrum, and it is desirable that the amount of the mercury is within a range of $10^{-7}$~$10^{-3}$ mol/cc.

The bulb of the electrodeless lamp system as above has following operations and effects.

First, the power supply 3 supplies the power source to the magnetron 2, and the magnetron 2 is oscillated by the power source to generated microwave having very high frequency.

The microwave is irradiated into the resonator 6 through the waveguide 4 to excite the buffer gas filled in the bulb 5, and thereby, the primary bulb fill becomes plasma continuously to generate the light having its own emission spectrum. The light is reflected to forward direction by the reflector 7 and the dielectric mirror 8, and space is enlightened.

At that time, the stannum bromide is filled in the light emitting portion 5*a* of the bulb as the primary bulb fill, and as described above, when the stannum bromide is used, high photoefficiency more than 80 lumen/watt and superior color rendering can be obtained.

Also, the stannum bromide irradiates less ultraviolet ray than that of sulfur, and gives a warm feeling visually.

On the other hand, the mercury is used as the auxiliary bulb fill in order to make the initial discharging easy and to stabilize the discharging.

Hereinafter, the characteristics of the present invention will be described with reference to the graph shown in FIG. 2.

FIG. 2 shows experimental result of comparing luminosity factors of a case that the sulfur is used as the primary bulb fill as in the conventional art (graph ②), and of first embodiment and second embodiment of the present invention which use the stannum bromide as the primary bulb fill and are different in size of the bulb 5 and filling pressure from each other (graphs ③ and ④).

The conventional art is a case that 400 W power source, inner diameter of the bulb of 23 mm and the sulfur as the primary bulb fill are applied, the first embodiment uses 400 W power source, bulb having 23 mm inner diameter, 30 torr of Ar filling pressure, and 10 mg of stannum bromide, and second embodiment uses 300 W power source, bulb having 13 mm inner diameter, 10 torr of Ar, 2 mg of stannum bromide, and 2 mg mercury.

As shown in FIG. 2, the case that uses the stannum bromide as the primary bulb fill is similar to the luminosity factor curve more than the conventional art using the sulfur as the primary bulb fill, based on the luminosity factor curve (graph ①).

The present invention has higher luminosity factor than the conventional art even in inferior condition (second embodiment), as well as in the same condition (first embodiment).

Therefore, the electrodeless lamp system using the stannum bromide according to the present invention uses the stannum bromide as the primary bulb fill in the bulb, and therefore, high photoefficiency and superior color rendering can be obtained, and also, less ultraviolet ray is irradiated than that of the sulfur and warm feeling can be obtained visually.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A bulb of an electrodeless lamp system using stannum (Sn) as a primary bulb fill in order to provide a continuous spectrum in discharging, wherein an auxiliary bulb fill filled in the bulb is mercury for stabilizing the discharge and changing the spectrum.

2. The bulb of claim 1, wherein the primary bulb fill is a halogenide of Sn.

3. The bulb of claim 2, wherein the halogenide of Sn is stannum bromide ($SnBr_2$).

4. The bulb of claim 1, wherein a filling amount of the primary bulb fill is within a range of 0.005~0.1 mol/cc.

5. The bulb of claim 1, wherein buffer gas filled in the bulb for contributing initial discharging includes at least one or more among Ne, Ar, Kr and Xe.

6. The bulb of claim 1, wherein the mercury is added to be an amount within a range of $10^{-7}$~$10^{-3}$ mol/cc.

7. The bulb of claim 1, wherein the capacity of the bulb has 50 watt/cc or more power consumption concentration.

8. An electrodeless lamp system comprising:

a microwave generator for generating microwave radiation by being supplied power from a source;

a resonator blocking the generated microwave radiation and transmitting emitted light; and a bulb, in which filled luminescent material becomes plasma by the generated microwave radiation to generate the light, wherein the bulb includes a primary bulb fill in order to obtain a continuous spectrum when discharging, and wherein mercury is added to the bulb as an auxiliary bulb fill for stabilizing the discharge and for changing the spectrum.

9. The system of claim 8, wherein the primary bulb fill is stannum (Sn).

10. The system of claim 8, wherein the primary bulb fill is a halogenide of Sn.

11. The system of claim 10, wherein the halogenide of Sn is stannum bromide ($SnBr_2$).

12. The system of claim 8, wherein the primary bulb fill is filled within a range of 0.005~0.1 mol/cc.

13. The system of claim 8, wherein buffer gas filled in the bulb for contributing to initial discharging includes at least one or more among Ne, Ar, Kr and Xe.

14. The system of claim 8, wherein the amount of mercury is within a range of $10^{-7}$~$10^{-3}$ mol/cc.

15. The system of claim 8, wherein the capacity of the bulb has 50 watt/cc or more power consumption concentration.

* * * * *